US007614903B1

(12) United States Patent
Huang

(10) Patent No.: US 7,614,903 B1
(45) Date of Patent: Nov. 10, 2009

(54) SOCKET FOR A QUICK CONNECTOR

(76) Inventor: Kui-Hsien Huang, 10F-1, No. 452, Sec. 5, Cheng Kung Rd., Nei Hu District, Taipei City (TW)

( * ) Notice: Subject to any disclaimer, the term of this patent is extended or adjusted under 35 U.S.C. 154(b) by 0 days.

(21) Appl. No.: 12/171,304

(22) Filed: Jul. 11, 2008

(51) Int. Cl.
*H01R 13/56* (2006.01)

(52) U.S. Cl. ..... 439/446; 439/362; 439/67

(58) Field of Classification Search ..... 439/446, 439/445, 465, 362, 67
See application file for complete search history.

(56) References Cited

U.S. PATENT DOCUMENTS

| | | | | |
|---|---|---|---|---|
| 5,788,534 | A * | 8/1998 | Koegel et al. | 439/465 |
| 6,083,031 | A * | 7/2000 | Kuo | 439/362 |
| 6,254,411 | B1 * | 7/2001 | Chapman et al. | 439/189 |
| 6,406,314 | B1 * | 6/2002 | Byrne | 439/215 |
| 6,475,021 | B1 * | 11/2002 | Tan et al. | 439/446 |
| 7,234,963 | B1 * | 6/2007 | Huang | 439/446 |
| 7,399,209 | B2 * | 7/2008 | Kodaira | 439/640 |
| 2005/0085104 | A1 * | 4/2005 | Stockhaus et al. | 439/67 |
| 2008/0207021 | A1 * | 8/2008 | Hsu et al. | 439/79 |

* cited by examiner

*Primary Examiner*—Hien Vu
(74) *Attorney, Agent, or Firm*—Leong C. Lei

(57) ABSTRACT

A socket for a quick-connector having a main housing has a top and bottom housing, and a non-connected wall having one side and the front wall of a recessed space are provided with a fastening peg corresponding to a peg slot provided at the bottom housing, allowing the two housings to be mounted and engaged such that the circuit board, the flexible circuit board, the terminal platform, the male or female socket and the locking bolt are contained therein, and the rear rotating section is formed by the top and the bottom rear section housing as a hollow pivotal shaft, which is engaged within the recessed space and the slot of the pivot, allowing a 0 to 180 degree rotation, the interior of the rear section is the cable mounting, for holding the cable which branches from the rear rotating section housing to form a hollow pivot shaft to the main housing; the terminal platform, the male or female socket and the flexible circuit board are soldered to form a connected component.

1 Claim, 5 Drawing Sheets

SOCKET FOR A QUICK CONNECTOR

BACKGROUND OF THE INVENTION (a) Technical Field of the Invention

The present invention relates to socket, and in particular, a socket for a quick-connector, allowing a connected socket to adjust at an angle ranging from 0 to 180 degree.

(b) Description of the Prior Art

Conventional types of sockets generally are not adjustable or not possess mechanism to adjust. The drawbacks of such sockets are as follows:

Problems are found when a conventional socket is used to connect with many sets of connectors, and the installation of the socket is difficult; as a result of long term twisting of cable, the cable has no way to restore to its original shape; conventional connector or socket is easily dislocated as a result of constant pulling of the cable; the cable of the socket is generally too lengthy and thereof, the cable may entangle with other devices; and the length of the cable may be insufficient long, and therefore, a new socket is needed.

The above-mentioned drawbacks are mitigated in accordance with one object of the present invention.

SUMMARY OF THE INVENTION

The primary purpose of the present invention is to provide a socket for a quick connector comprising a main housing, a circuit board, a flexible circuit board, a terminal platform, a male or female socket, a rear rotating section, a cable mounting and a locking bolt at the lateral side thereof, characterized in that the main housing has a top and bottom housing, and a non-connected wall having one side and the front wall of a recessed space are provided with a fastening peg corresponding to a peg slot provided at the bottom housing, allowing the two housings to be mounted and engaged such that the circuit board, the flexible circuit board, the terminal platform, the male or female socket and the locking bolt are contained therein, and the rear rotating section is formed by the top and the bottom rear section housing as a hollow pivotal shaft, which is engaged within the recessed space and the slot of the pivot, allowing a 0 to 180 degree rotation, the interior of the rear section is the cable mounting, for holding the cable which branches from the rear rotating section housing to form a hollow pivot shaft to the main housing and is then engaged with the terminal platform; wherein the terminal platform, the male or female socket and the flexible circuit board are soldered to form a connected component, the front of the circuit board is extended to form the flexible circuit board such that the flexible circuit board and the pins are soldered, the flexible circuit board is 90 degree which is used to change the vector of the male or female socket, and wherein the terminal platform is soldered on the circuit board in a front and a rear arrangement and is corresponding to the rear position of the male or female socket, which is arranged in horizontal, the rear terminal platform has a sloping surface and each terminal is provided with a cable hole and each cable corresponds to a locking device, thereby the locking device locks the branched cable of each cable hole.

Yet still another object of the present invention to provide a socket for a quick-connector, wherein the extended lateral sides of the male or female socket are provided with a locking screw bolt for screw connection.

A further object of the present invention is to provide a socket for a quick connector, wherein the terminal platform is one or more than one.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
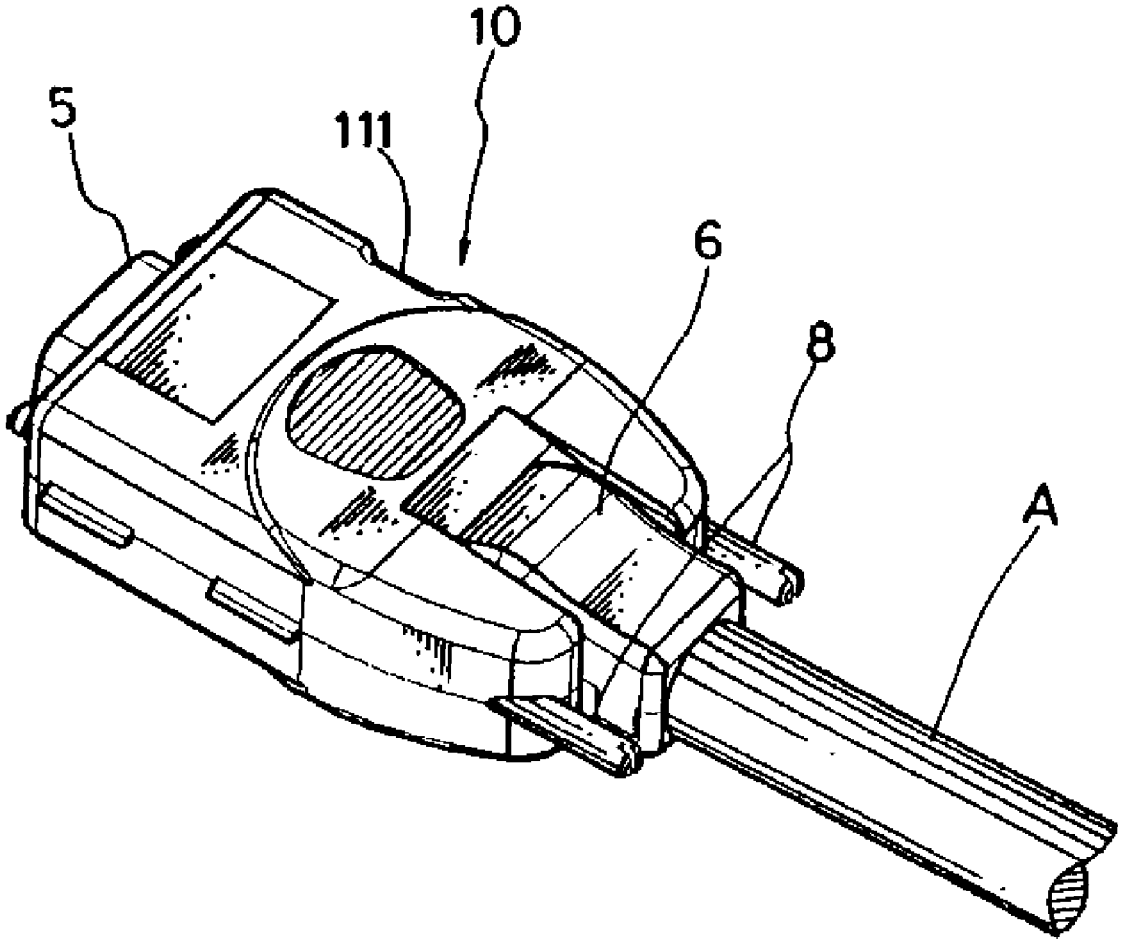
FIG. 1 is a perspective view of a preferred embodiment of the present invention.

Referring to FIG. 1, there is shown a connector 10 for a quick connector in accordance with the present invention. A male or female socket 5 is used to connect to an article, and a locking screw bolt 8 at the lateral sides is used to secure to the socket 5.

Figure 2:
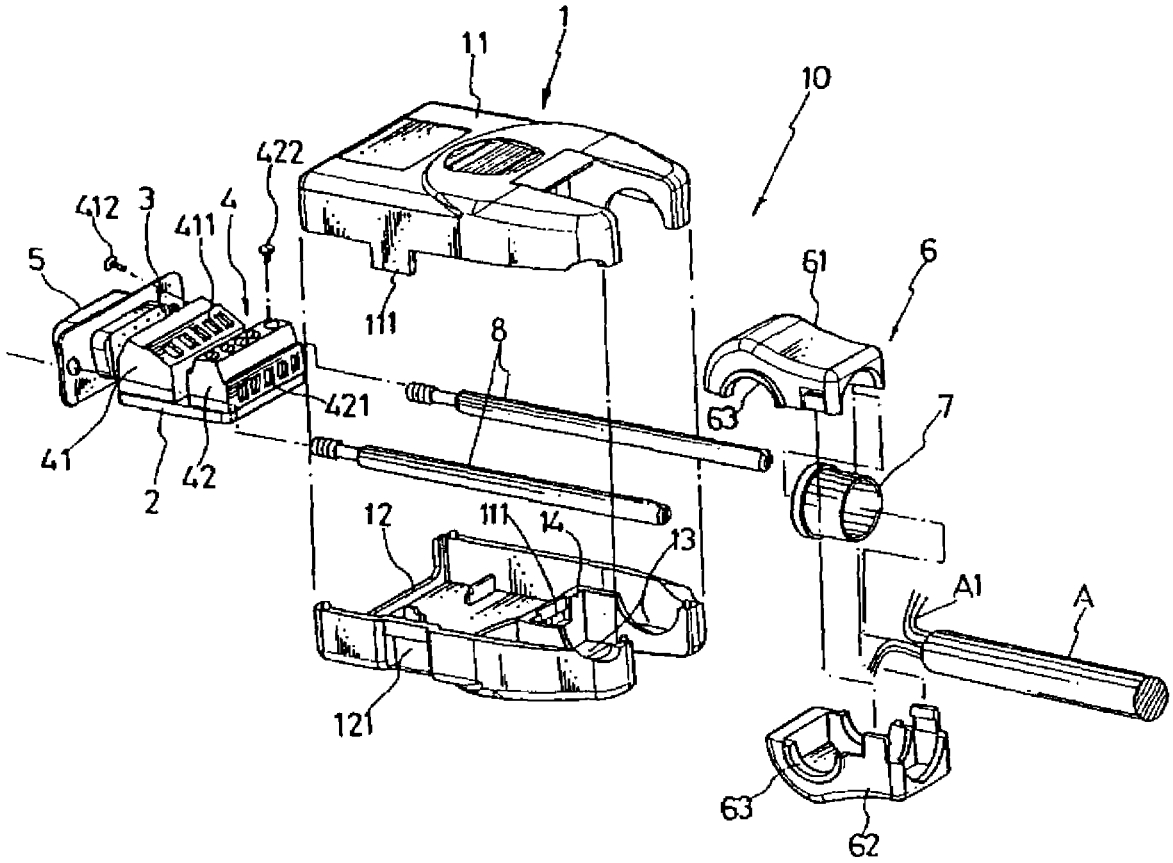
FIG. 2 is an exploded perspective view of the socket in accordance with the present invention.

As shown in FIG. 2, the connector 10 comprises a main housing 1, a circuit board 2, a flexible circuit board 3, a terminal platform 4, a male or female socket 5, a rear rotating section 6, a cable mounting 7, and a locking screw bolt 8 at the lateral sides thereof. The main housing 1 comprises a top housing 11 and a bottom housing 12, and the two housings 11, 12 correspondingly in engagement with each other such that the circuit board 2, the flexible circuit board 3, the terminal platform 4, the male or female socket 5 and a part of the locking screw bolt 5 are contained within the interior of the main housing 1. The rear rotating section 6 comprises the top and bottom rear rotating housings 61, 62 to form a hollow pivotal shaft 63, which is pivotally mounted to the recessed space of a pivotal slot 13 on the main housing 1, forming the main body of the connector 10.

The two opposite lateral sides and the inner end side of the top housing 11 are each provided with a fastening peg 111

Figure 5:
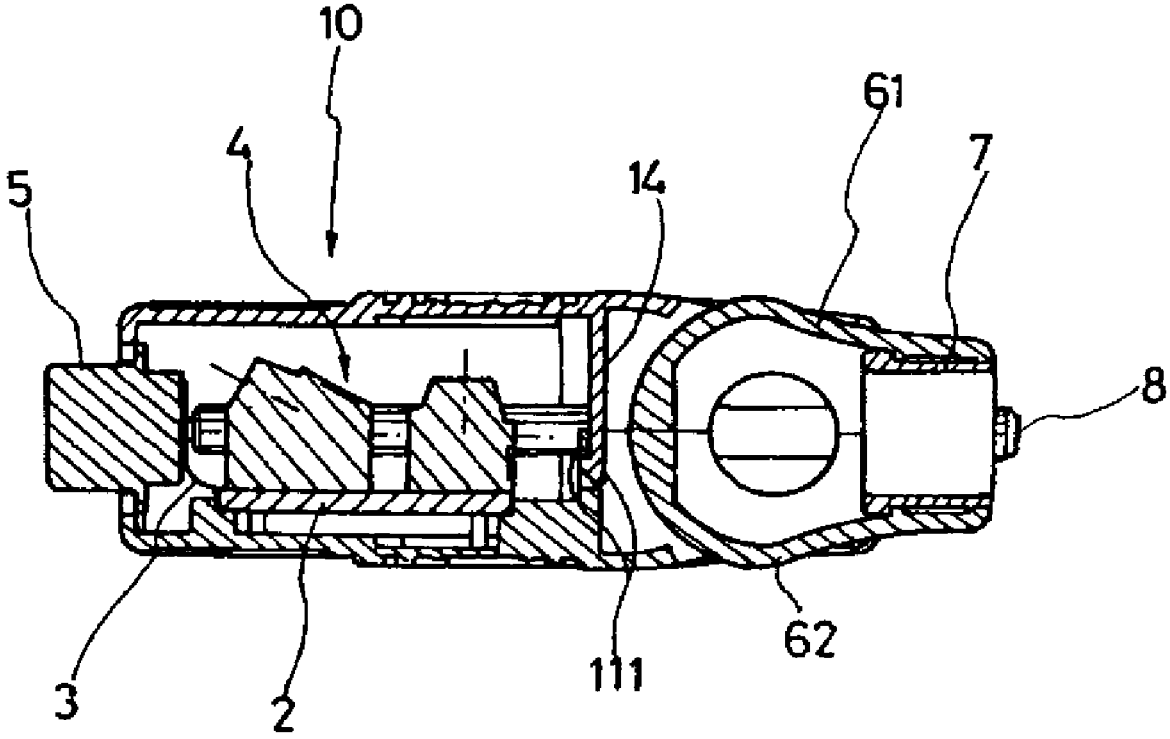
FIG. 5 is a sectional view of the socket in accordance with the present invention.

(shown in FIG. 5), which corresponds to a pegging slot 121 at the bottom housing 12, allowing the two housings 11, 12 to fasten, forming a secured engagement, and within the interior of the top and bottom rear rotating housings 61, 62. Further, a cable mounting 7 is used to fully seal and engage the cable A.

As shown in FIG. 2, cable A passes through the cable mounting 7 and is engaged by the rear rotating housings 61, 62, and the branched cable A1 is engaged at the rear-rotating housings 61, 62 to form a hollow pivot shaft 63, passing through the interior of the main housing 1 and the branched cable A1 is arranged on the terminal platform A.

Figure 3:
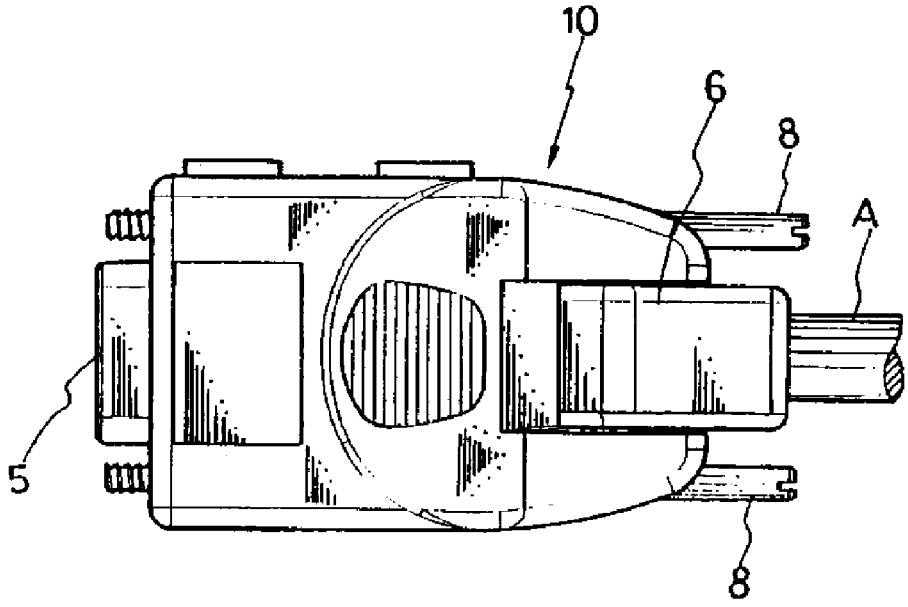
FIG. 3 is a top view of the socket of the present invention.
Figure 6:
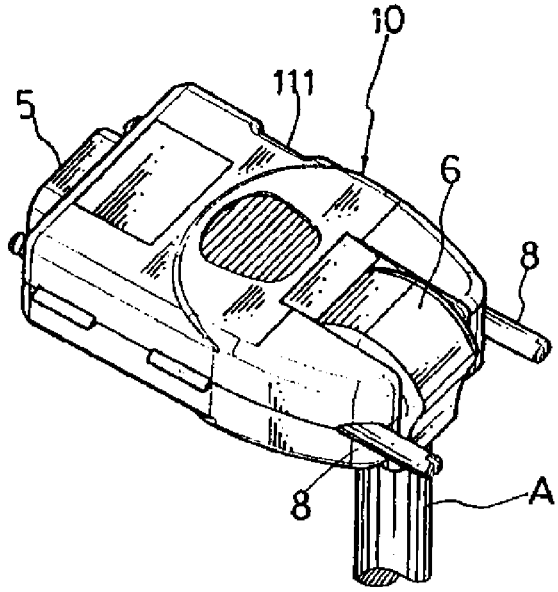
FIG. 6 is a schematic view showing an adjustment of the socket of the present invention.
Figure 7:
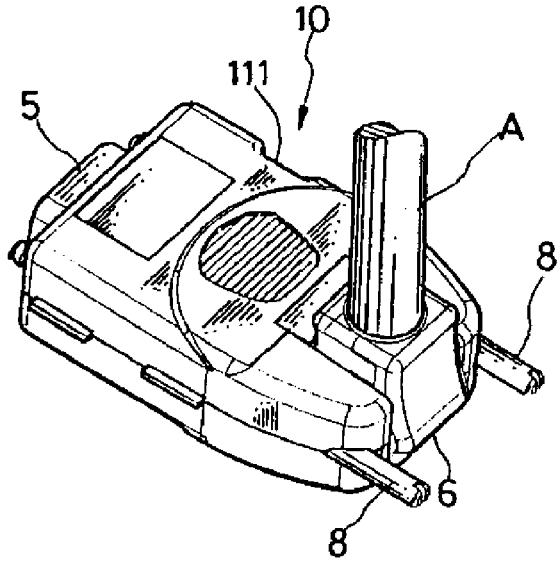
FIG. 7 is another schematic view showing an adjustment of the socket of the present invention.

As shown in FIGS. 3, 6 and 7, the rear rotating section 6 comprises a top and bottom rear rotating housings 61, 62, and other than a cable mounting, it corresponds to the recessed space of the main housing 1. The hollow pivotal shaft 63 formed from the top and bottom rear rotating housings 61, 62 is pivotally formed within the pivotal slot 13 at the rear section of the main housing 1, so that the socket 5 of the quick connector and the cable A is provided with an adjustment of 0 to 180 degree.

Figure 4:
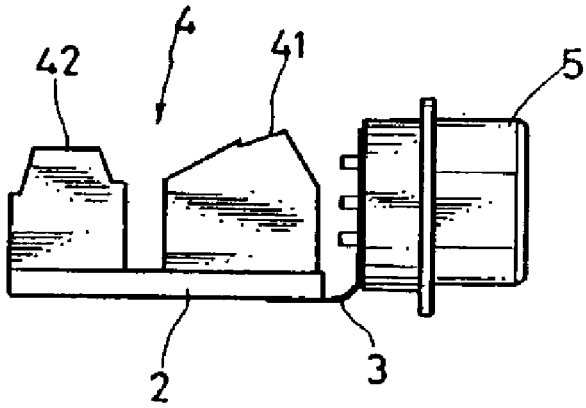
FIG. 4 is a schematic view showing the terminal platform, the male or female socket, the circuit board and the flexible circuit board of the present invention.

Referring to FIG. 4, the terminal platform 4, the male or female socket 4, the circuit 2 and the flexible circuit 3 within the socket 10 are soldered. The circuit board 2 is extended with a flexible circuit board 3, and the flexible circuit board 3 and each of the pins of male or female connector 5 are soldered and the flexible circuit board 3 allows a 90 degree adjustment the direction of the male or female socket, facilitating the installation of the top and bottom housings 11, 12 of the connector. The terminal platform 4 are arranged one after the other (one in front and one at the back) on the top of the circuit board, and at the same time, corresponding to the rear position of the male or female socket 5.

Referring to FIG. 2, the front terminal platform 41 of the terminal platform 4 is provided with cable holes 411 facing externally, and the cable hole 421 on the platform surface of the rear direction terminal platform 42 is provided with a sloping face, allowing the installed cable and fixed cable will not cause an obstacle to the space. At the same time, each of the installed cable holes 411, 421 of each terminal platform is correspondingly to screws 412, 422, which are used to secure and lock the cable A.

As shown in FIGS. 3 and 4, the male or female connector 5 is provided at the front position of the circuit board 2, and the terminal section is either a male connector or a female connector, and the lateral side, a screw bolt 8 is extended.

When in application, the rear rotating section 6 is rotated and adjustment with respect to direction is achieved, as shown in FIGS. 6 and 7.

In accordance with the present invention, one or more than one terminal platform 4 is used based on the specification and the demand on the socket 10. It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A quick connector comprising:

a main housing composed of a top housing and a bottom housing, said main housing being formed with a pivotal slot having a recessed space, said top housing having two opposite lateral sides and an inner end side which are each provided with a fastening peg which corresponds to a pegging slot of said bottom housing thereby allowing said top and bottom housings to be secured together;

a circuit board;

a terminal platform mounted on said circuit board and having a first terminal platform and a second terminal platform, said first terminal platform being provided with cable holes facing externally, said second terminal platform having cable holes and a sloping surface;

a socket connected with said circuit board via a flexible circuit board thereby enabling said socket to be adjusted in position;

a rear rotating section having a top rear rotating housing and a bottom rear rotating housing engaged with said top rear rotating housing to form a hollow pivotal shaft which is pivotally mounted on said recessed space of said pivotal slot;

a cable mounting mounted between said top rear rotating housing and said bottom rear rotating housing;

a pair of locking screw bolts extending through said main housing and said socket to engage with screws; and a cable extending through said cable mounting to engage with said terminal platform.

* * * * *